US010639218B2

(12) United States Patent
Wong et al.

(10) Patent No.: US 10,639,218 B2
(45) Date of Patent: May 5, 2020

(54) MANUAL LIFTING SLING DEVICE

(71) Applicants: Cho Kee Wong, Hong Kong (CN); Wai Jun Sabrina Wong Yeung, Hong Kong (CN)

(72) Inventors: Cho Kee Wong, Hong Kong (CN); Wai Jun Sabrina Wong Yeung, Hong Kong (CN)

( * ) Notice: Subject to any disclaimer, the term of this patent is extended or adjusted under 35 U.S.C. 154(b) by 345 days.

(21) Appl. No.: 15/549,695

(22) PCT Filed: Jun. 25, 2017

(86) PCT No.: PCT/IB2017/053789
§ 371 (c)(1),
(2) Date: Aug. 9, 2017

(87) PCT Pub. No.: WO2018/002804
PCT Pub. Date: Jan. 4, 2018

(65) Prior Publication Data

US 2018/0235821 A1 Aug. 23, 2018

(30) Foreign Application Priority Data

Jun. 30, 2016 (HK) ..... 16107664

(51) Int. Cl.

| | |
|---|---|
| ***A61G 1/01*** | (2006.01) |
| ***A61G 1/013*** | (2006.01) |
| ***A61G 7/10*** | (2006.01) |
| *A61G 1/017* | (2006.01) |
| *A61G 1/048* | (2006.01) |
| *A61G 1/044* | (2006.01) |

(52) U.S. Cl.
CPC ..... *A61G 1/01* (2013.01); *A61G 1/013* (2013.01); *A61G 7/1023* (2013.01); *A61G 7/1051* (2013.01); *A61G 1/017* (2013.01); *A61G 1/044* (2013.01); *A61G 1/048* (2013.01)

(58) Field of Classification Search
CPC ..... A61G 1/01; A61G 1/013; A61G 1/044; A61G 1/017; A61G 7/1023; A61G 7/1051; A61G 7/10; A61G 7/16; A45F 3/26
See application file for complete search history.

(56) References Cited

U.S. PATENT DOCUMENTS 4,712,257 A * 12/1987 James ..... A61G 7/1017 5/83.1
4,742,588 A * 5/1988 James ..... A61G 7/10 5/83.1
5,442,821 A * 8/1995 Weeks ..... A61G 1/01 5/627

(Continued)

FOREIGN PATENT DOCUMENTS

CN 102727355 10/2012
CN 103083138 A 5/2013

(Continued)

*Primary Examiner* — Nicholas F Polito
*Assistant Examiner* — Rahib T Zaman

(57) ABSTRACT

A manual lifting sling device including a bottom support portion, a rear side support portion, a left side retainer portion and a right side retainer portion, at least two lift handles, a left foldable portion, and a right foldable portion; wherein the manual lifting sling device is configured to be switchable between a standby state in the form of a sheet and an operation state in the form of a seat.

12 Claims, 10 Drawing Sheets

(56) References Cited

U.S. PATENT DOCUMENTS

| | | | | |
|---|---|---|---|---|
| 9,867,452 | B1 * | 1/2018 | Martinez | A45F 3/26 |
| 10,350,123 | B2 * | 7/2019 | Wong | |
| 2005/0132495 | A1 * | 6/2005 | Girard | A61G 1/01 5/625 |
| 2005/0283907 | A1 * | 12/2005 | Dalton | A61G 7/10 5/89.1 |
| 2007/0180625 | A1 * | 8/2007 | Walke | A61G 7/0504 5/706 |
| 2009/0199335 | A1 * | 8/2009 | Guldmann | A61G 7/1015 5/87.1 |
| 2013/0115841 | A1 * | 5/2013 | Ronner | D03D 15/0066 442/211 |
| 2013/0227789 | A1 * | 9/2013 | Olson | A61G 1/013 5/625 |
| 2015/0337094 | A1 * | 11/2015 | Wong | B32B 5/022 524/35 |
| 2015/0342810 | A1 * | 12/2015 | Wong | A61G 7/1051 5/83.1 |
| 2015/0342811 | A1 * | 12/2015 | Wong | A61G 7/1023 5/81.1 T |
| 2015/0353726 | A1 * | 12/2015 | Wong | C08L 67/04 524/35 |
| 2017/0181910 | A1 * | 6/2017 | Petterson | A61G 7/1015 |

FOREIGN PATENT DOCUMENTS

| | | | |
|---|---|---|---|
| CN | 103476379 | | 12/2013 |
| CN | 104271102 | | 1/2015 |
| EP | 0827730 | A1 | 3/1998 |
| FR | 2806620 | | 12/2002 |

* cited by examiner

MANUAL LIFTING SLING DEVICE

TECHNICAL FIELD

The present disclosure relates to a lifting device, and more particularly to an improved manual lifting sling device.

BACKGROUND ART

Lifting sling devices are always used in hospitals to transport patients or disabled people. The critical issue in using lifting sling devices is how to prevent accident and cross-infection between patients. The earliest lifting sling device is made of woven fabrics, which is relatively complex in structure and not reasonable enough in design, whereby making the product costly.

To this end, CN103083138A, as filed by the inventor of the present invention, has disclosed a manual lifting sling device, which is incorporated herein by reference. In practical use, the three-dimensional configuration of the manual lifting sling device might cause several problems. For example, the configuration in the form of a seat adopted by the manual lifting sling device requires the patient to be seated exactly into the confined space between the left retainer portion and the right retainer portion, otherwise the handle will be pressed or suppressed by the patient and might not function properly. If the patient is in an unconscious state or cannot move on his own, it might require additional manpower or a third caregiver to manually pre-adjust or right the "seat" insitu to facilitate the proper seating of the patient to enhance overall efficiency when the patient is moved to or seated on the "seat" via two caregivers. In this way, it can be seen that the invention is relatively difficult to use when there is no enough caregivers, or the patient might need to be moved multiple times, or its efficiency might be reduced substantially at the time.

BRIEF SUMMARY OF INVENTION

The present disclosure relates to a manual lifting sling device, preferably made of a fabric, comprising a bottom support portion for supporting buttocks and legs of a user, a rear side support portion for supporting the user's back, a left side retainer portion and a right side retainer portion respectively arranged at the left side and the right side and connected with both the bottom support portion and the rear side support portion, and at least two lift handles arranged respectively at each of the left side retainer portion and the right side retainer portion; and a left foldable portion arranged at the left side and respectively connected with the left side retainer portion, the bottom support portion and the rear side support portion; and a right foldable portion arranged at the right side and respectively connected with the right side retainer portion, the bottom support portion and the rear side support portion;

wherein the manual lifting sling device is configured to be switchable between a standby state and an operation state preferably via a predetermined transformation of the left foldable portion and/or the right foldable portion, and/or a predetermined operation or motion of the handle;

while in the standby state the manual lifting sling device is configured to be in a fully or at least partially unfolded configuration and substantially in form of a two-dimensional sheet having its entirety or at least one preset active portion being in a flat state for facilitating rolling up operation, stacking operation, storage operation, transport operation, and/or operation for insertion underneath the user; and preferably, the left foldable portion, the right foldable portion, the bottom support portion, the rear side support portion, the left side retainer portion, and/or the right side retainer portion are coplanar; and while in the operation state the manual lifting sling device is configured to be in a partially folded configuration and substantially in form of a three-dimensional seat with its entirety being in a three-dimensional state for facilitating seating and/or transport operations of the user; and preferably, the bottom support portion and the rear side support portion are intersected at a first predetermined inclination angle, and both of them are further intersected with the left side retainer portion and the right side retainer portion at a second predetermined inclination angle; and preferably the left side retainer portion and the right side retainer portion are further arranged opposingly and in parallel to each other; and preferably, each of the left and right foldable portions is folded respectively along its center axis and selectively further folded toward respective retainer portions and fixed thereto.

In some embodiments, the left and right foldable portions are respectively arranged at transverse ends or ends in width direction of the manual lifting sling device and/or respective centre portions of the left side and/or right side retainer portions; while in the standby state the left foldable portion and/or the right foldable portion being in the unfolded configuration and in coplanar with the bottom support portion, the rear side support portion, the left side retainer portion, and the right side retainer portion; and/or a profile/contour of the left foldable portion and/or the right foldable portion is protruded transversely from respective profiles/contours of respective retainer portions; while in the operation state the left foldable portion and/or the right foldable portion being in the folded or overlapped configuration in which the left foldable portion and the right foldable portion might then be respectively connected firmly with or completely engaged with or in parallel with the left side retainer portion and the right side retainer portion preferably by hook and loop fasteners or Velcro; and/or the profile/contour of the left foldable portion and/or the right foldable portion is preferably incorporated with respective profiles/contours of respective retainer portions and thus being visually hidden or in a concealed state.

In some embodiments of the manual lifting sling device according to the present disclosure, the fabric is a textile fabric or nonwoven fabric.

In some embodiments, an edge of the left foldable portion, the right foldable portion, the bottom support portion, the rear side support portion, the left retainer portion, and/or the right side retainer portion is folded, pre-folded, and/or stiffened; and/or the left foldable portion, the right foldable portion, the bottom support portion, the rear side support portion, the left side retainer portion, and the right side retainer portion are integrally formed preferably by sewing.

In some embodiments, the bottom support portion, the rear side support portion, the left side retainer portion, the right side retainer portion, the left foldable portion, and/or the right foldable portion is/are cut to fit human body and provided with a fold/folds.

In some embodiments, the fabric comprises an identification; and/or the fabric comprises a layer of textile film or nonwoven film or a composite layer formed by laminating multiple layers of textile film or nonwoven film.

In some embodiments, one side, or both sides, or a top surface, and/or a bottom surface of the fabric comprise an air permeable non-biodegradable or biodegradable film.

In some embodiments, the fabric comprises a thermally bonded non-biodegradable or biodegradable randomly oriented fiber; and/or a continuous filament web or a short fiber web formed by spunlace or needle punch.

In some embodiments, the fabric comprises a continuous filament web or a short fiber web formed by bonding of a non-biodegradable or biodegradable chemical, and the chemical comprises a latex binder and/or adhesive.

The present disclosure also provides a method for preventing cross-infections between patients being conveyed, characterized in that, having each of patients provided with and conveyed by any one of the foregoing manual lifting sling devices.

In some embodiments, a patient with mobility incapacity might be moved to a matched/complementary equipment, such as a wheelchair or a stretcher, via the foregoing manual lifting sling device of the present disclosure, so as to move the patient to a designated or intermediate location first, and then move the patient out of the wheelchair or stretcher for further treatments, such that direct contact or displacement of patient's body could be prevented during transport, so as to avoid causing inadvertently accidental injury to the patient, such as sprain or the like; and reducing the contacting time with the patient's body, whereby reducing also the chance of being infected.

The manual lifting sling device provided by the present invention is simple in structure, reasonable in design, high in comfort and low in cost, such that it enables the provision of a dedicated manual lifting sling device for each patient for multiple use. In addition, the manual lifting sling device provided by the present disclosure is preferably and most suitable and most effective for first aid, particularly for use in a variety of complex environments, which allows the injured person to be moved out of the scene of the accident or danger, such as the scene of the fire or the collapsed building, or the place where the stretcher of the ambulance cannot enter or be used to move out the patient in normal circumstances, in the shortest possible time or as soon as possible, while in the above circumstances the manual lifting sling device of the present disclosure could then be effect and realize its practical functionality and use in an advantageous manner.

BRIEF DESCRIPTION OF DRAWINGS

The present disclosure will be described in details below with reference to the accompanying drawings, in which.

DETAILED DESCRIPTION OF INVENTION

The present disclosure will now be described in further details with reference to the accompanying drawings and embodiments, so as to make the objects, technical solutions and advantages of the present disclosure clearer.

The present disclosure relates to a manual lifting sling device for supporting the body of the patient for manual handling. In some cases, such a manual lifting sling device might also be used as a stretcher. The terms "manual lifting sling device", "sling", "lifting sling", and "stretcher", might be used interchangeably in the description of the present disclosure and refer to slings or stretchers adapted for frequent use by caregivers or transporters for the patient. For example, the device might be used to transport an injured patient from an incident site to a nearby ambulance, where it might be referred as a stretcher. When the patient is subsequently moved from a bed to another location in the hospital, the device might be referred as a lifting sling device.

The present disclosure also provides a method of preventing cross-infection between patients who are transported by the manual lifting sling device, i.e., these patients are transported by two persons using a non-biodegradable or biodegradable manual lifting sling, wherein each of the patients has own dedicated manual lifting sling device. Preferably, each lifting sling device is clearly marked to identify clearly which patient is dedicated to the sling. The lifting sling can be marked with a persistent ink to protect it from being used by others. Further, the fabric in the lifting sling is made of environmentally friendly biodegradable polymeric material, and it has been found that the cost of biodegradable nonwoven sling is only a fraction of the cost of the textile sling and affordable by most people. Thus, each person might be provided with a dedicated sling, so as to prevent cross-infections between patients. Since the environmentally friendly fabric material adopted by the manual lifting sling device could be biodegraded to $CO_2$, $H_2O$, and/or compostable/fertilizer, for example, such that the slings discarded after use could be completely returned to nature, whereby reducing the use of landfills and not contaminating the environment.

Figure 1A:
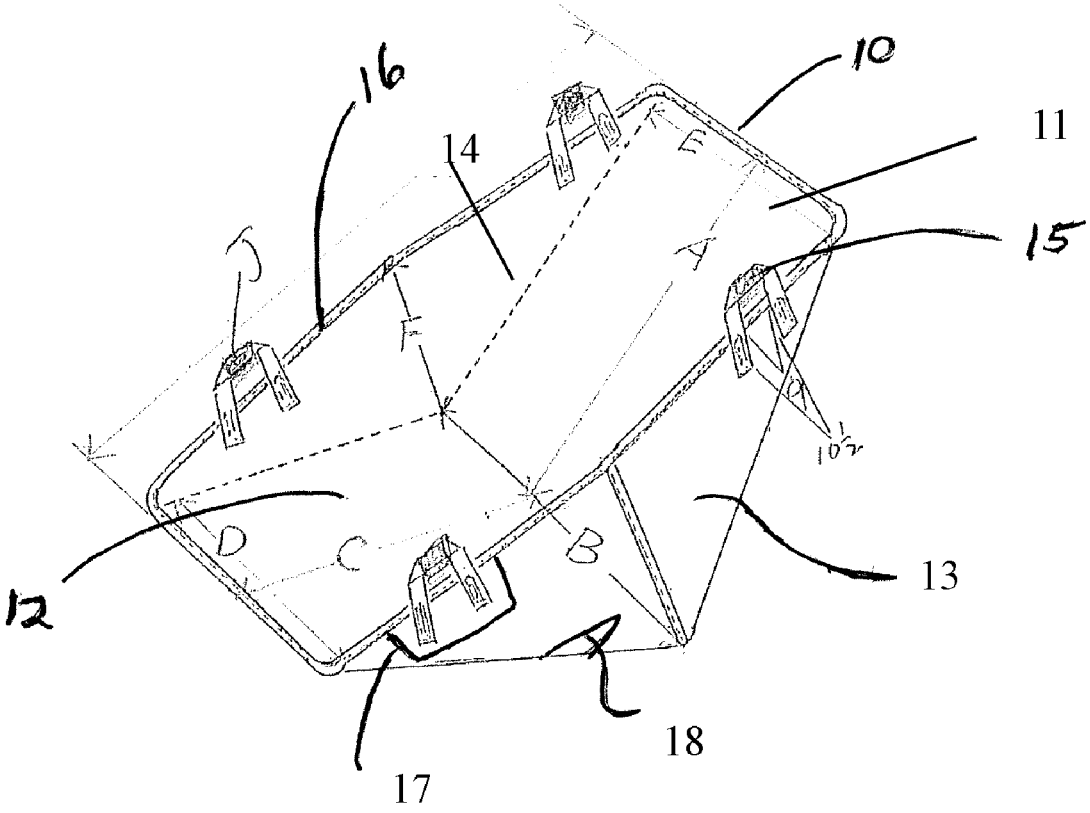
FIG. 1A is a perspective view of a prior art manual lifting sling device.

FIG. 1A is a perspective view of some basic portions of a prior art and also a manual lifting sling device according to a preferred embodiment of the present disclosure. As shown in FIG. 1A, the depicted manual lifting sling device 10 comprises a bottom support portion 12, a rear side support portion 11, a left side retainer portion 13, and a right side retainer portion 14, all made of a fabric. Wherein the bottom support portion 12 is located at the bottom for supporting the buttocks and legs of the patient. The rear side support portion 11 is configured to form an inclination angle with the bottom support portion 12 for supporting the back of the patient. The lower side edge of the rear side support portion 11 engages with the rear side edge of the bottom support portion 12 and the inclination angle is preferably an obtuse angle to facilitate the seating of the patient in the manual lifting sling device 10. The rear side support portion 11 and the bottom support portion 12 are preferably in the form/shape of an isosceles trapezoid with two longer side edges being joined together.

The left side retainer portion 13 and the right side retainer portion 14 are adapted to retain/keep the patient in place by acting at the left and right sides, respectively. The left side retainer portion 13 and the right side retainer portion 14 are simultaneously engaged with the bottom support portion 12 and the rear side support portion 11. In some embodiments, the left retainer portion 13 is substantially triangular in shape, wherein one of the bottom edges is connected with the left waist of the bottom support portion 12 and the other bottom edge is connected with the left waist of the rear side support portion 11. Similarly, the right side retainer portion 14 is configured in a corresponding manner to the left retainer portion 13. In other embodiments, the left side retainer portion 13 of FIG. 1A consists of two triangles respectively engaged with the bottom support portion 12 or the rear side support portion 11, so as to expand the space enclosed by the manual lifting sling device 10. The manual lifting sling device 10 is symmetrical with respect to the central axis thereof.

At least two lift handles 15 are arranged at both the left side retainer portion 13 and the right side retainer portion 14. For example, in the present embodiment, a lift handle 15 is arranged respectively at the upper side and the lower side of the left side retainer portion 13, so as to act on a back region and a leg region of the patient. Similarly, the right side stopper 14 is also provided with two lift handles 15.

Preferably, the edges of the bottom support portion 12, the rear side support portion 11, the left side retainer portion 13, and the right side retainer portion 14 are folded and/or stiffened, and the foregoing portions are integrally formed preferably by sewing. For example, the edge 16 is folded several times and stitched/sewed or ultrasonic bonded. Preferably, the bottom support portion 12 and the rear side support portion 11 are cut to conform to the profile of human body, and provided with a fold 18, for example. The area 17, where the lift handle 15 is arranged, is stiffened, for example, it might be subjected to a thickening process, and a fabric film might be arranged additionally on the fabric.

In addition, an identification might be arranged on the fabric of the manual lifting sling device 10. For example, a label might be sewed thereon or a text might be written thereon with a pen of persistent ink. For example, patient's name or some other common recognition words, such as "Do not clean", "No ironing", "Do not dry", or the like, might be written on the label.

Figure 2:
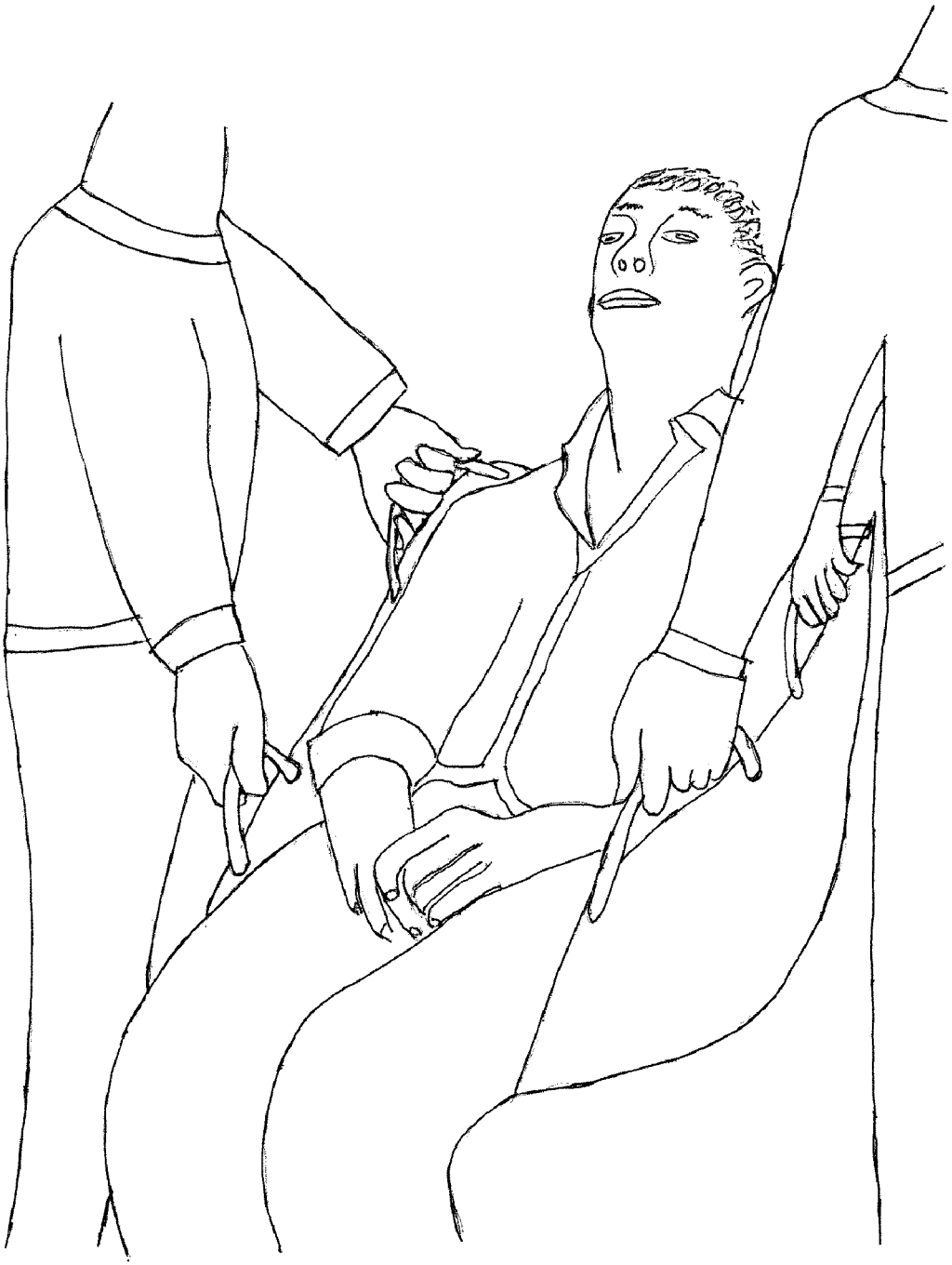
FIG. 2 is a schematic view of an operation state of a manual lifting sling device according to a preferred embodiment of the present disclosure.

FIG. 2 is a schematic view of an operation state of a manual lifting sling device according to a preferred embodiment of the present disclosure. The patient sits into the space enclosed by the manual lifting sling device, by which the back, buttocks and legs are supported. The manual lifting sling device is conveyed by two persons. Each of them grabs the two handles at each side of the sling, one of the handles is adapted for supporting the patient's back and the other one is configured to support the buttocks and legs of the patient.

However, if the patient is in a non-awake state or cannot move on his own, then it is not that easy to have the patient be sit in the space enclosed by the manual lifting sling device. For example, depending on the weight or condition of the patient, the patient might be moved over the space by one or two caregivers, and then be positioned and situated in place slowly and carefully with respect to the space, during which time it might require additional manpower or a third caregiver to manually adjust or to right the sling device in the form of a "seat", so as to prevent the handle from being pressed or suppressed by the patient and failed to function properly, and the patient might not need to be moved multiple times whereby enhancing the overall efficiency thereof. Thus, it can be seen that the sling device is relatively difficult to use when there is no enough caregivers, or its efficiency might be reduced substantially then.

Figure 3A:
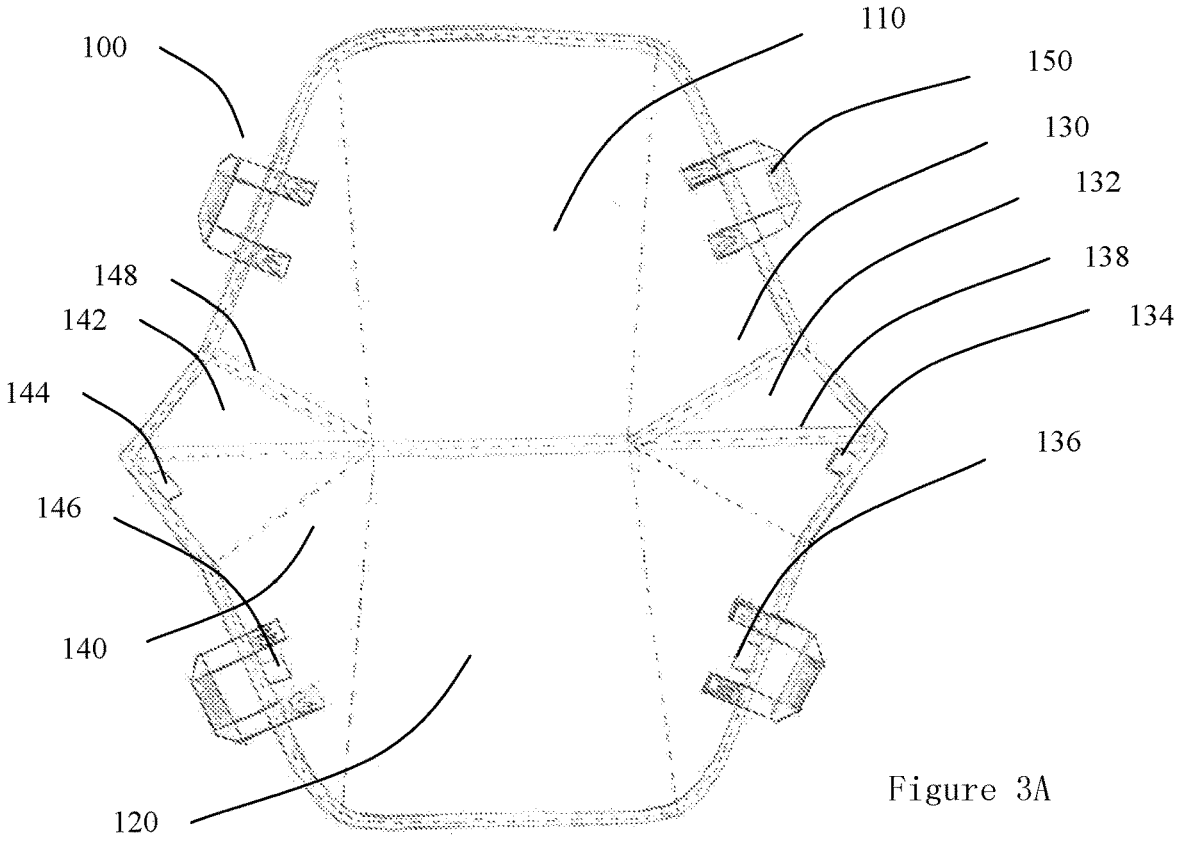
FIGS. 3A-3B are schematic views of a manual lifting sling device being in various operation states in accordance with another preferred embodiment of the present disclosure.
Figure 3B:
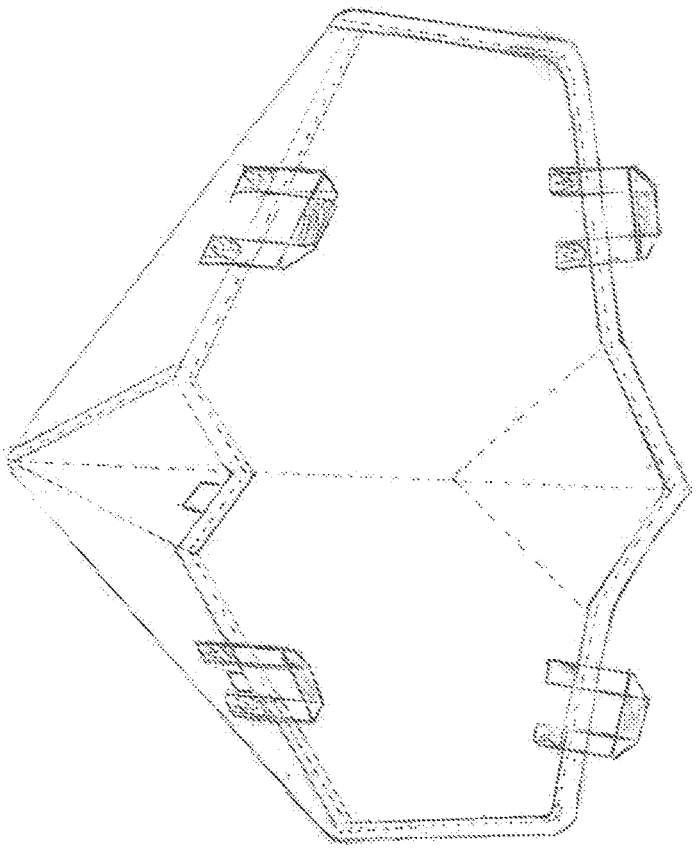

FIGS. 3A-3B are schematic views of a manual lifting sling device being in various operation states in accordance with another preferred embodiment of the present disclosure. Similar to the one shown in FIG. 1A, the manual lifting sling device 100 also comprises a bottom support portion 120 for supporting the patient's buttocks and legs; a rear side support portion 110 for supporting the back of the patient; the left side retainer portion 130 and the right side retainer portion 140 arranged at respective sides of the device, and both the left side retainer portion and the right side retainer portion are simultaneously connected/engaged with the bottom support portion and the rear side support portion; and each of the left side retainer portion and the right side retainer portion is provided with at least two lift handles 150.

The manual lifting sling device 100 further comprises a left foldable portion 132 arranged at the left side and respectively connected with the left side retainer portion, the bottom support portion and the rear side support portion; and a right foldable portion 142 arranged at the right side and respectively connected with the right side retainer portion, the bottom support portion and the rear side support portion; wherein the manual lifting sling device is configured to be switchable between a standby state substantially in form of a two-dimensional sheet, an intermediate state (half-sheet-half-seat state, or partially sheet and partially seat state adapted for specific applications or operations), and an operation state substantially in form of a three-dimensional seat, preferably via a transformation conducted in a predetermined manner of the left foldable portion and/or the right foldable portion, and/or via a predetermined operation or the motion of the handle carried out in a predetermined manner (such as lifting the handle and restoring its position).

While in the standby state, the manual lifting sling device is configured to be in a fully or at least partially unfolded configuration and substantially in form of a two-dimensional sheet having its entirety or at least one preset active portion (namely the portion involved in a specific operation) being in a flat state for facilitating rolling up operation, stacking operation, storage operation, transport operation, and/or operation for insertion into the underneath of the user or the removal therefrom (for example, the left side retainer portion, the right side retainer portion, the bottom support portion, the rear side support portion, the left foldable portion, and/or the right foldable portion might be in a flat state for facilitating insertion underneath/into a specific part of the patient or removal therefrom; while being inserted underneath the waist of the patient, the left foldable portion and the right foldable portion acting as the active portion could be in parallel or orthogonal to each other). Preferably, the left foldable portion, the right foldable portion, the bottom support portion, the rear side support portion, the left side retainer portion, and/or the right side retainer portion are configured to be coplanar, which ensures that there is no any protruding part that might be undesirably and accidentally pulling about or acting on the patient's body or medical device placed thereon when the sling device is entirely or partially inserted underneath the patient or the sling device is removed from the underneath of the patient, so as to avoid causing discomfort to the patient or the displacement of the medical device, whereby overcoming the defects of the prior art.

In the operation state, the manual lifting sling device is configured to be in a partially folded configuration and substantially in form of a seat with its entirety being in a three-dimensional state for facilitating seating and/or transport operations of the user/patient; and preferably, the bottom support portion and the rear side support portion are intersected at a first predetermined inclination angle, and both of them are further intersected with the left side retainer portion and the right side retainer portion at a second predetermined inclination angle; and preferably the left side retainer portion and the right side retainer portion are further arranged opposingly and in parallel to each other; and preferably, each of the left and right foldable portions is inclined to be folded respectively along its center axis, guide suture, pre-folded line, and/or stiffening strip, and selectively further folded toward respective retainer portions and fixed or connected thereto.

In some embodiments, the left and right foldable portions 132, 142 are respectively arranged at transverse ends or ends in width direction of the manual lifting sling device 100 and/or respective centre portions of the left side and/or right side retainer portions; while in the standby state the left foldable portion and/or the right foldable portion being in the unfolded configuration and in coplanar with the bottom support portion, the rear side support portion, the left side retainer portion, and the right side retainer portion; and/or a profile/contour of the left foldable portion and/or the right foldable portion is protruded transversely from respective profiles/contours of respective retainer portions; while in the operation state the left foldable portion and/or the right foldable portion being in the folded or overlapped configuration in which the left foldable portion and the right foldable portion might then be respectively connected firmly with or completely engaged with or in parallel with the left side retainer portion 130 and the right side retainer portion 140 preferably by fasteners and/or connection members (such as Velcro); and the profile/contour of the left foldable portion and/or the right foldable portion is preferably incorporated with respective profiles/contours of respective retainer portions and thus being visually hidden or in a concealed state.

In some embodiments, the area and size of the left foldable portion and the right foldable portion in its entirety (or in the unfolded configuration) or in a folded configuration are approximately ¼ to ½ of that of the left side retainer portion and the right side retainer portion, respectively, and they have similar or consistent/overlapped contours while in the operation state, so as to be visually fused together and produce the above hidden effect.

As shown in FIG. 3A, the manual lifting sling device 100 is in a fully unfolded configuration having its entirety being in a flat state or a standby state, the while the manual lifting sling device 100 as shown in FIG. 3B is in a partially folded configuration and a semi-operation state. The manual lifting sling device 100 as shown in FIG. 3A comprises various portions preferably made of fabric and being in a flat or standby state, including a bottom support portion 120, a rear side support portion 110, a left side retainer portion 130, and a right side retainer portion 140. In the operation state, the bottom support portion 120 is located at the bottom for supporting the buttocks and legs of the patient. The lower side edge of the rear side support portion 110 engages with the rear side edge of the bottom support portion 120 and the inclination angle formed therebetween is preferably an obtuse angle to facilitate the seating of the patient in the manual lifting sling device 100. In one of the configurations or operation states of the manual lifting sling device 100, the rear side support portion 110 and the bottom support portion 120 are preferably in the form of an isosceles trapezoid having its two longer side edges being joined together.

In some embodiments, the bottom support portion 120 and the rear side support portion 110 are of the same size. In other embodiments, the rear side support portion 110 might be larger, longer, wider and/or taller than the bottom support portion 120, for example, the rear side support portion might have an additional support portion for head and neck or other extended support portions (not shown), so as to provide better support for the head and neck or to facilitate/contribute to other specific applications.

In an operation state or configuration (as shown in FIG. 3B), the left side retainer portion 130 and the right side retainer portion 140 are positioned in an opposite manner to each other at the left and right sides, respectively. The left side retainer portion 130 and the right side retainer portion 140 are concurrently connected with the bottom support portion 120 and the rear side support portion 110. In some embodiments, the left retainer portion 130 is substantially in triangular form, wherein one of the bottom edges is connected with the left waist of the bottom support portion 120 and the other bottom edge is connected with the left waist of the rear side support portion 110. Similarly, the right side retainer portion 140 is configured in a corresponding manner to the left retainer portion 130. In other embodiments, the left side retainer portion 130 of FIG. 3A consists of two triangles respectively connected with the bottom support portion 120 or the rear side support portion 110, so as to expand the space enclosed by the manual lifting sling device 100. The manual lifting sling device 100 is symmetrical with respect to the central axis thereof.

In some embodiments, the left side retainer portion 130 and/or the right side retainer portion 140 comprise left/right foldable portions 132, 142, which are respectively arranged at transverse ends or ends in width direction of the manual lifting sling device 100; while in the standby state the left foldable portion and/or the right foldable portion are automatically inclined to be in a folded or overlapped configuration preferably via the guide suture and/or stiffening strip 138, 148. In the folded or overlapped configuration the left foldable portion and the right foldable portion might then be respectively connected firmly with or completely engaged with the left side retainer portion 130 and the right side retainer portion 140 preferably by fasteners and/or connection members, so as to be switched to a concealed state. In some embodiments, the respective foldable portions are symmetrical with respect to the guide suture and/or the stiffening strip 138.

At least two lift handles 150 are arranged at both the left side retainer portion 130 and the right side retainer portion 140. For example, in the present embodiment, a lift handle 150 is arranged respectively at the upper side and the lower side of the left side retainer portion 130, so as to act on a back region and a leg region of the patient. Similarly, the right side stopper 140 is also provided with two lift handles 150.

In some embodiments, the left retainer portion 130 and the right side retainer portion 140 are provided with Velcro 134, 136, 144, 146, which are preferably arranged at the respective side portions of the foldable portions 132, 142 and the corresponding portions in the middle of the handle 150, such that the foldable portions in the folded state might be attached to the left side retainer portion 130 and/or the right side retainer portion 140 by the Velcro when the manual lifting sling device 100 is in the operation state. The handle 150 provided with the Velcro 136,146 is preferably a handle 150 adapted for use with the bottom support portion 120.

Preferably, the edges of the left foldable portion, the right foldable portion, the bottom support portion 120, the rear side support portion 110, the left side retainer portion 130, and the right side retainer portion 140 are folded and/or stiffened, and the foregoing portions are integrally formed preferably by sewing. For example, the edges are folded several times and stitched/sewed or ultrasonic bonded. Preferably, the bottom support portion 120 and the rear side support portion 110 are cut to conform to the profile of human body, and provided with a fold/folds, for example. The area at which the lift handle 15 is arranged is stiffened, for example, it might be subjected to a thickening process, and a fabric film might be arranged additionally on the fabric.

Figure 4A:
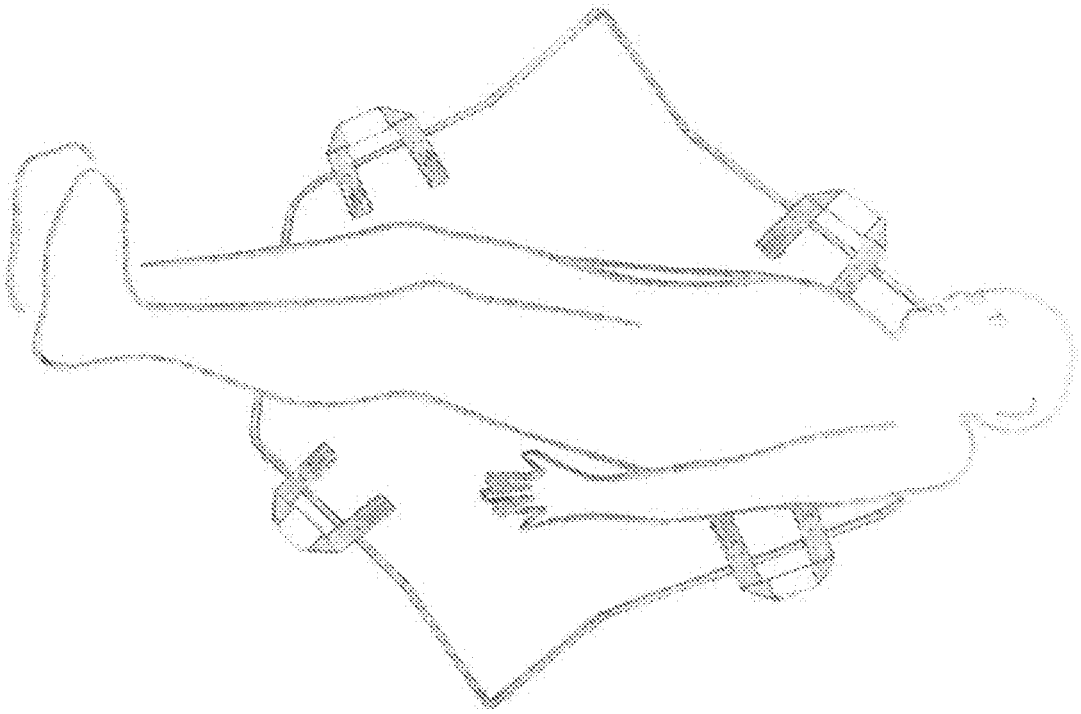
FIGS. 4A-4F are schematic views of an operation manner or process of a manual lifting sling device in accordance with still another preferred embodiment of the present disclosure.
Figure 4B:
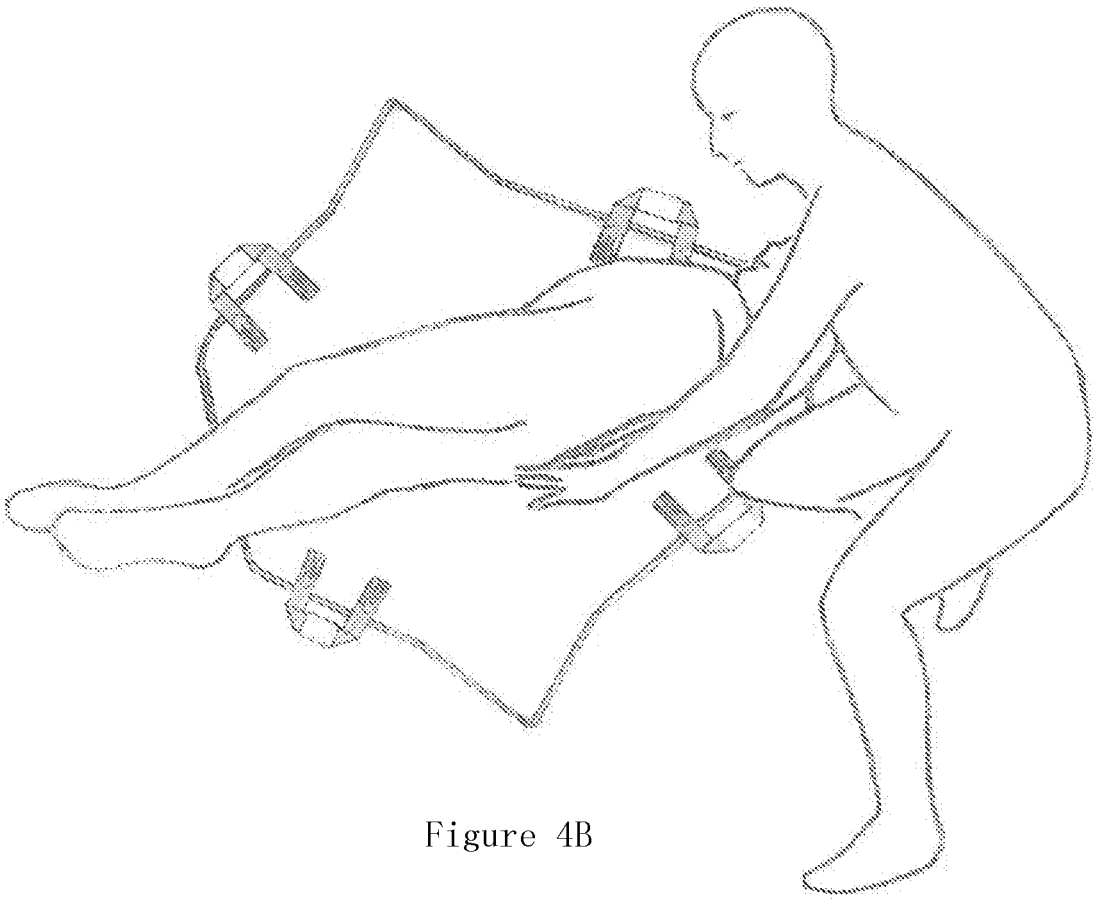
Figure 4C:
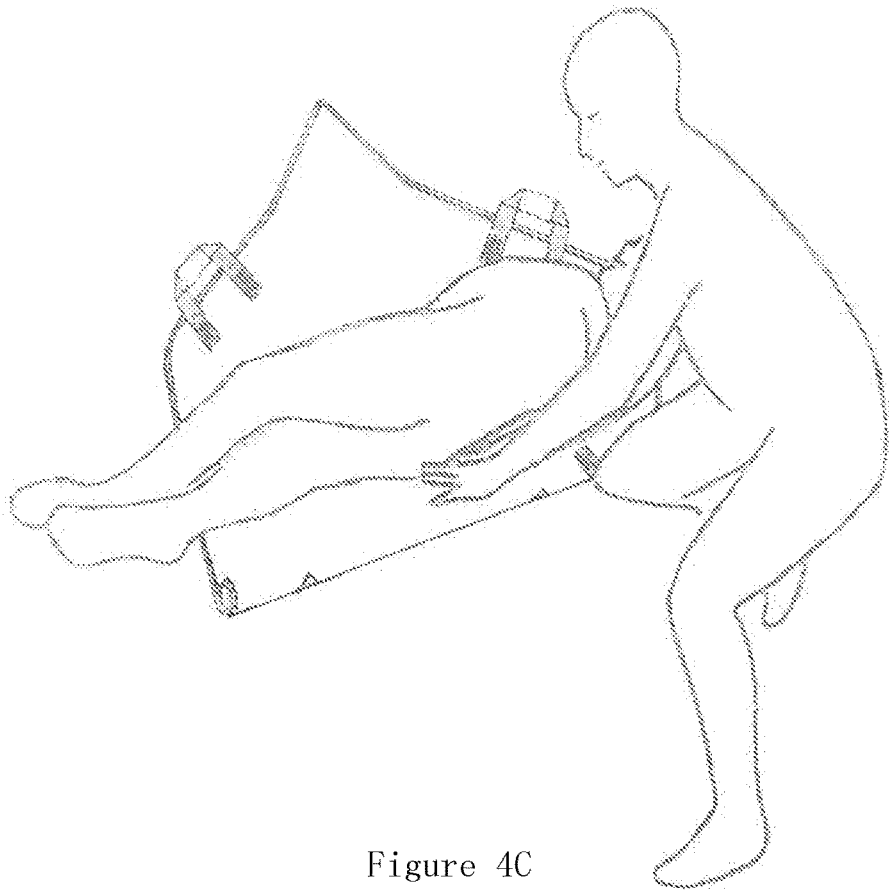
Figure 4D:
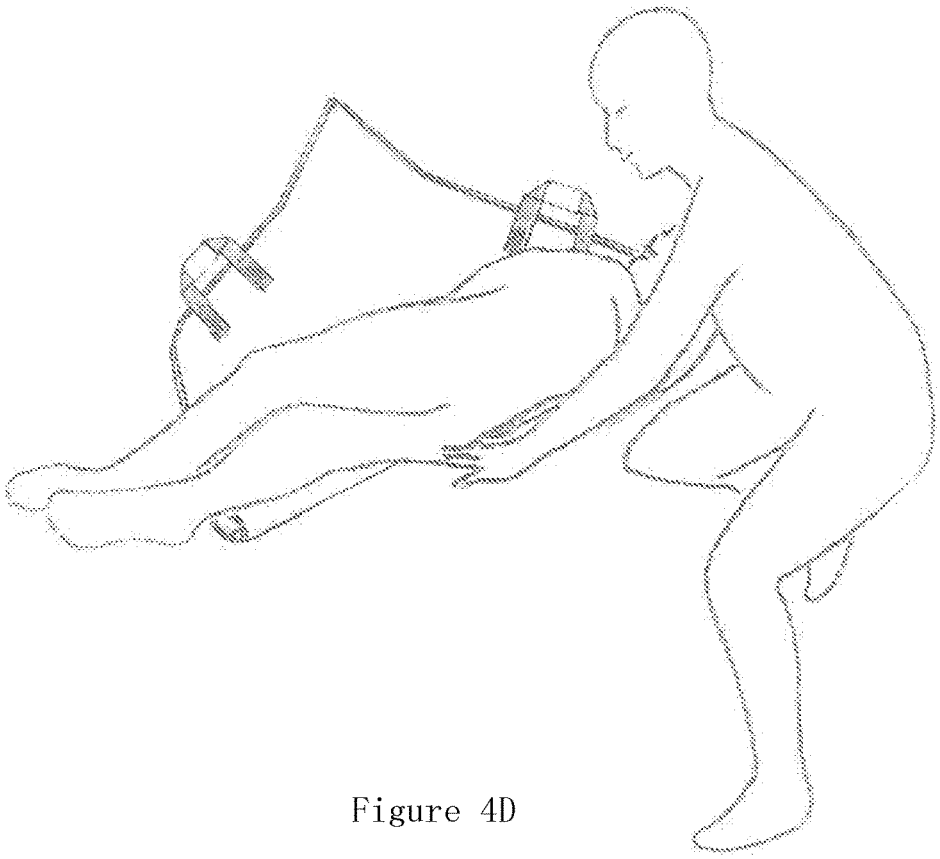
Figure 4E:
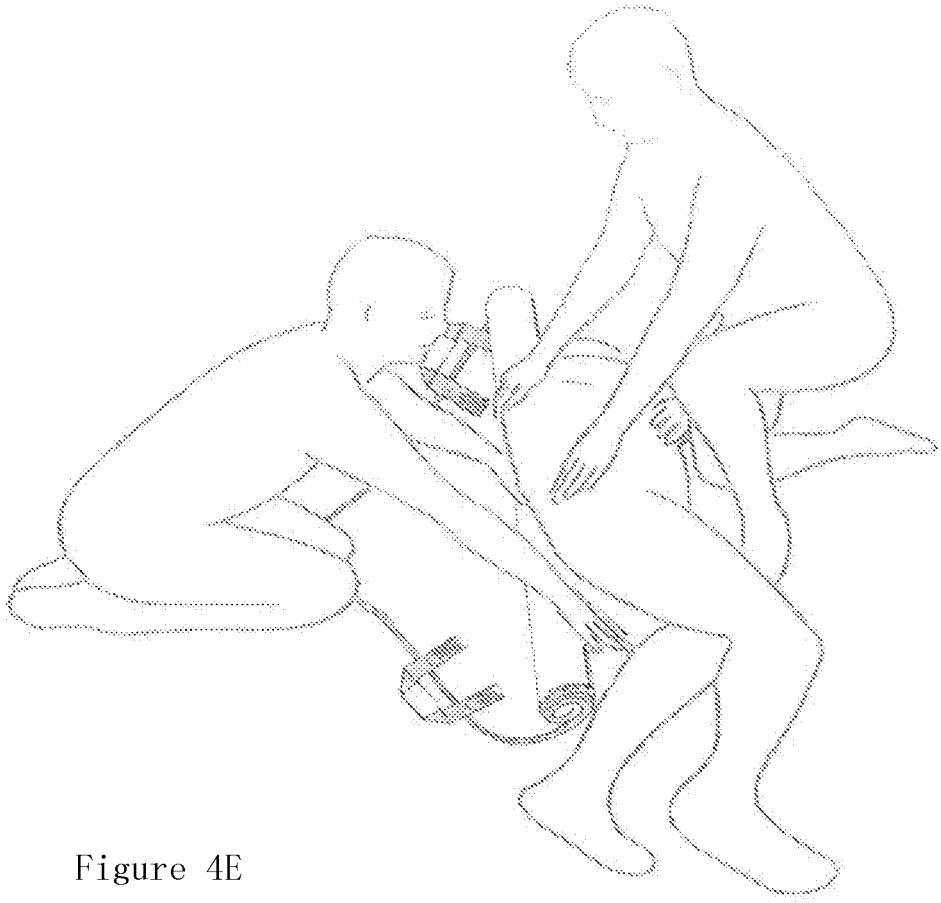
Figure 4F:
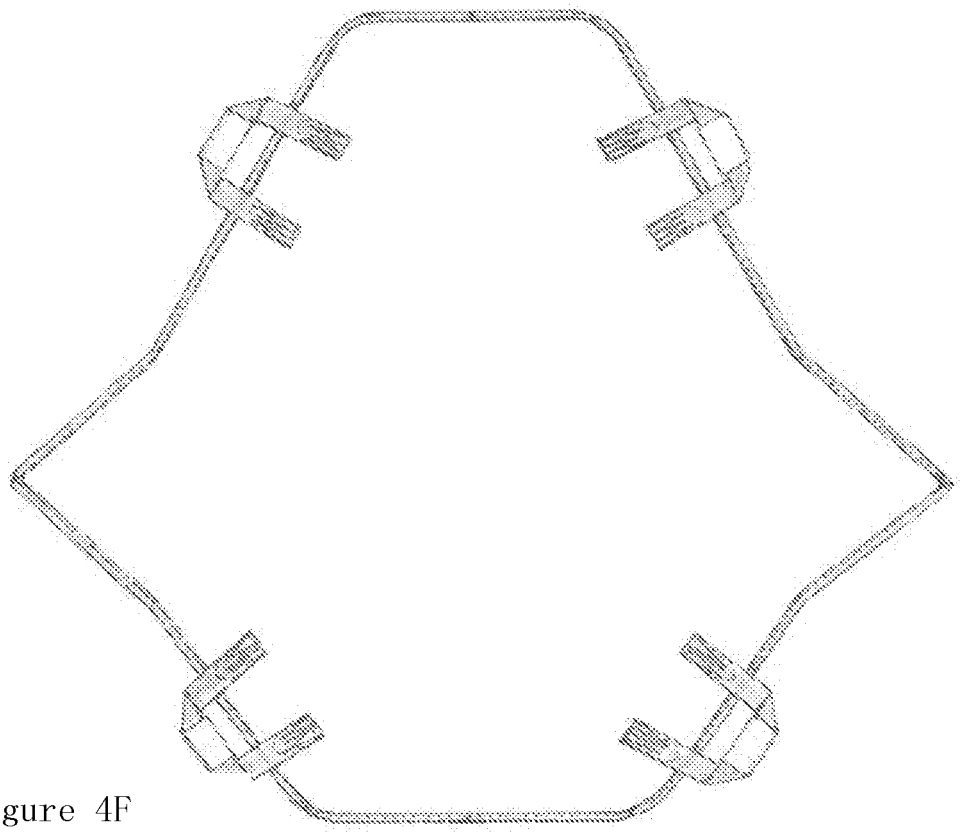

Referring to FIGS. 4A-4F, which are schematic views of an operation manner or process of a manual lifting sling device in accordance with still another preferred embodiment of the present disclosure. As shown in FIG. 4A, the patient is placed on a fully unfolded manual lifting sling device. As long as the handle is lifted, the configuration/state of the manual lifting sling device will be converted into the operation state and a space with a single opening enclosed by the bottom support portion 120, the rear side support portion 110, the left side retainer portion 130, and the right side retainer portion 140 is formed, and the patient is automatically transformed into a seated pose for facilitating easy transport, and after the patient is transported and moved to a bed or other specific positions, the manual lifting sling device could be collected for reuse or recycling. Firstly, lowering the handle to enable the manual lifting sling device to convert into a flat and standby state; and then having the patient to be lying on the right side as shown in FIG. 4B. Afterwards, as shown in FIGS. 4C-4D, rolling up the flat portion of the manual lifting sling device and placing it adjacent to the patient; lifting the patient's body and then having the patient to be lying on the left side as shown in FIG. 4E; and moving the rolled up portion of the manual lifting sling device from the left side to the right side of the patient while lifting the patient's body; and removing the manual lifting sling device and having it to be converted into the flat and standby state as shown in FIG. 4F. Definitely, if sufficient manpower is available, it might also possible to raise slightly the patient, and then remove the planar type manual lifting sling device directly from the underneath of the patient without having to convert the sling device into the rolled up state, where the sling device of planar type configuration is not only conducive to the foregoing operations, but also can be used as a cover or cloak for keeping warm for the patient.

As shown in FIG. 4F, as the manual lifting sling device is configured to be in a fully unfolded configuration and substantially in form of a sheet having its entirety being in a flat state while it is in the standby state, such a sheet of the planar configuration not only facilitates its stacking, storage and transportation operations, but also facilitates the corresponding roll-up and unfolding operations in order to be conducive to its insertion into the underneath of the patient or the removal therefrom, which simplifies positioning of the patient relative to the sling device, and the positioning operation could be carried out by fewer people. For example, the operations as shown in FIGS. 4A to 4E might be performed by a single person, while the prior art sling device of three-dimensional configuration as shown in FIG. 1A might require at least two persons to ensure performing of a relatively efficient positioning operation of sling and patient transfer operation.

Figure 5A:
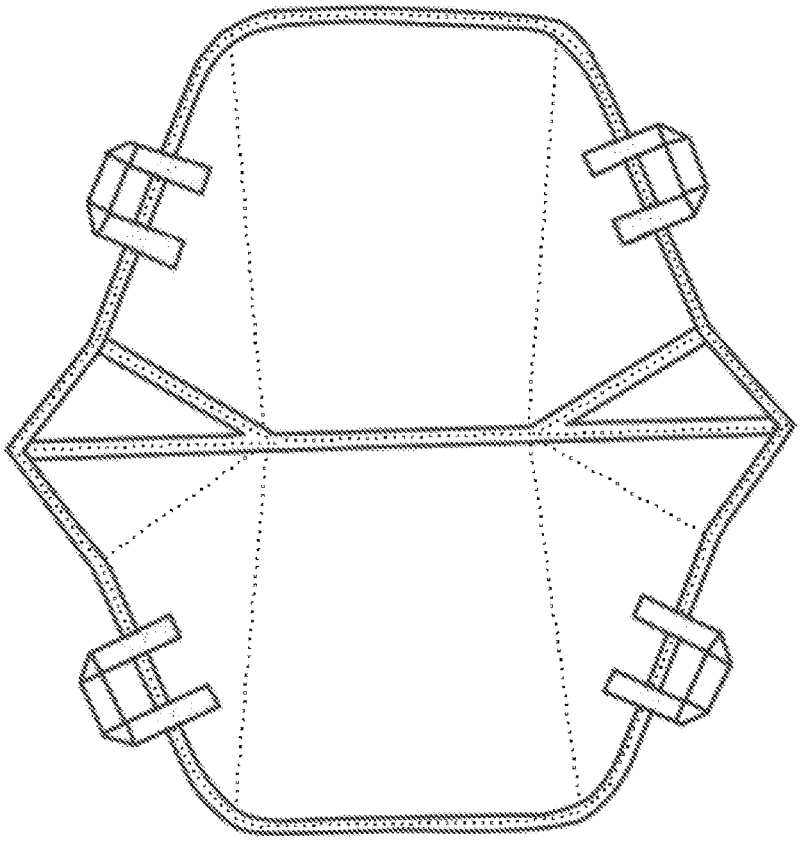
FIGS. 5A-5I are schematic views of a manual lifting sling device being in various operation states or configurations in accordance with a further preferred embodiment of the present disclosure.
Figure 5B:
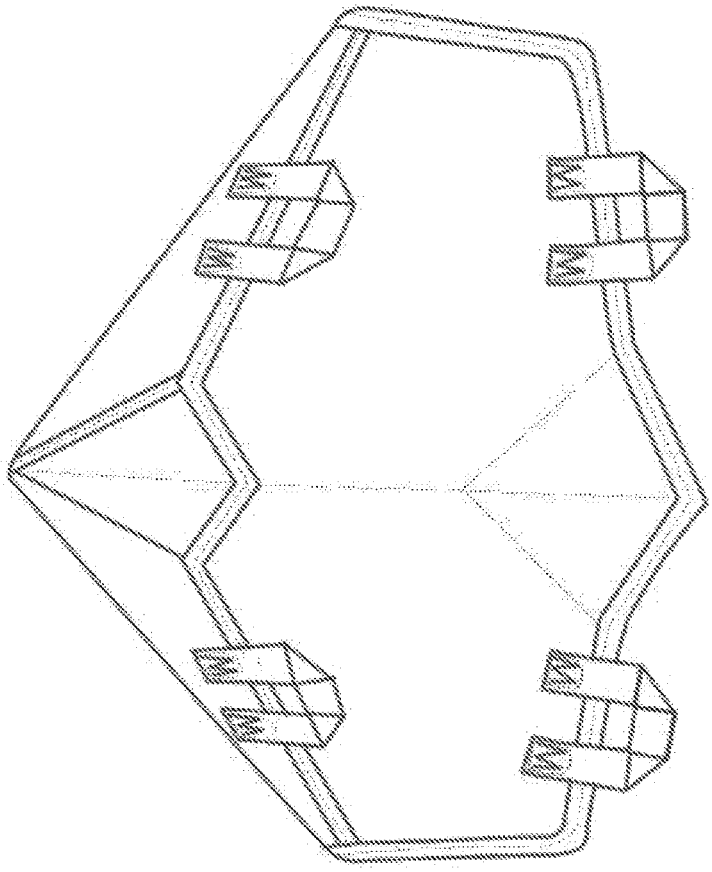
Figure 5C:
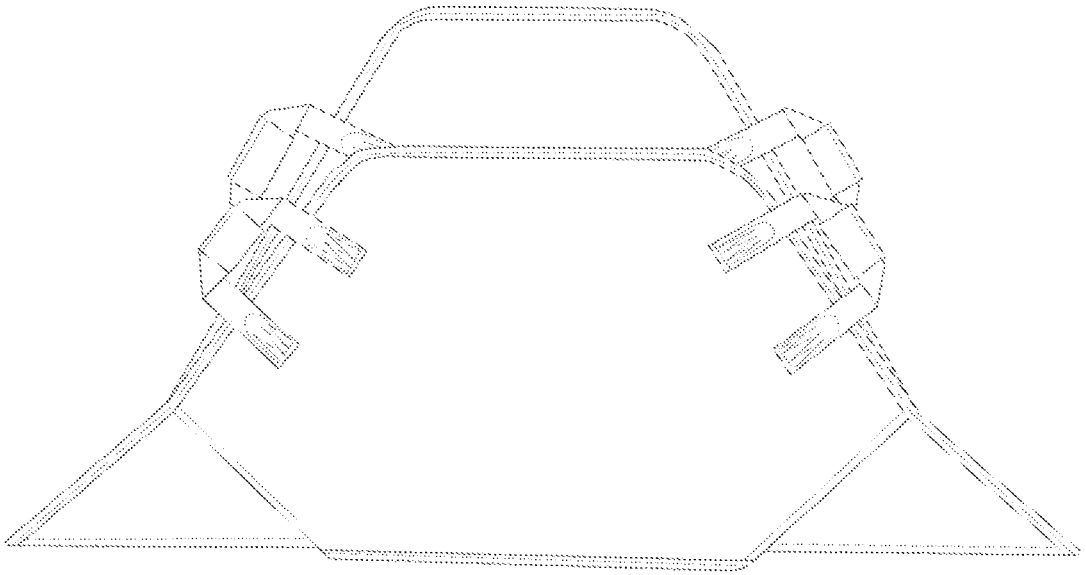
Figure 5D:
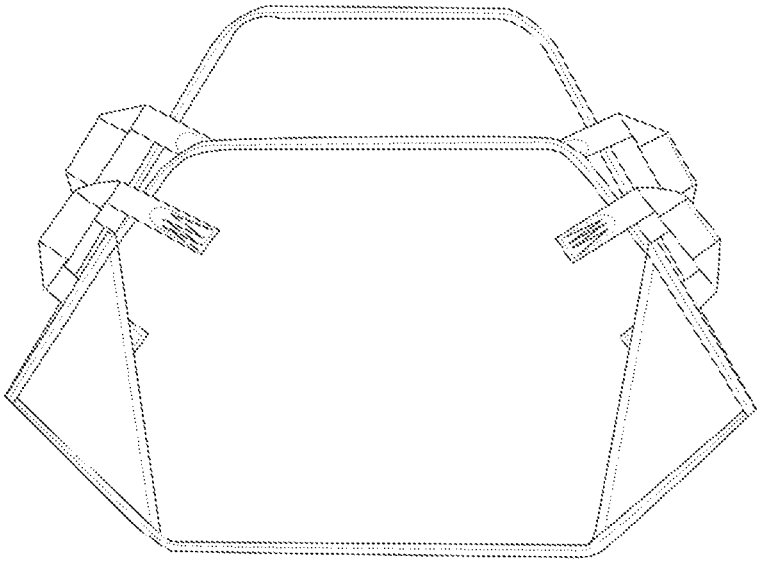
Figure 5E:
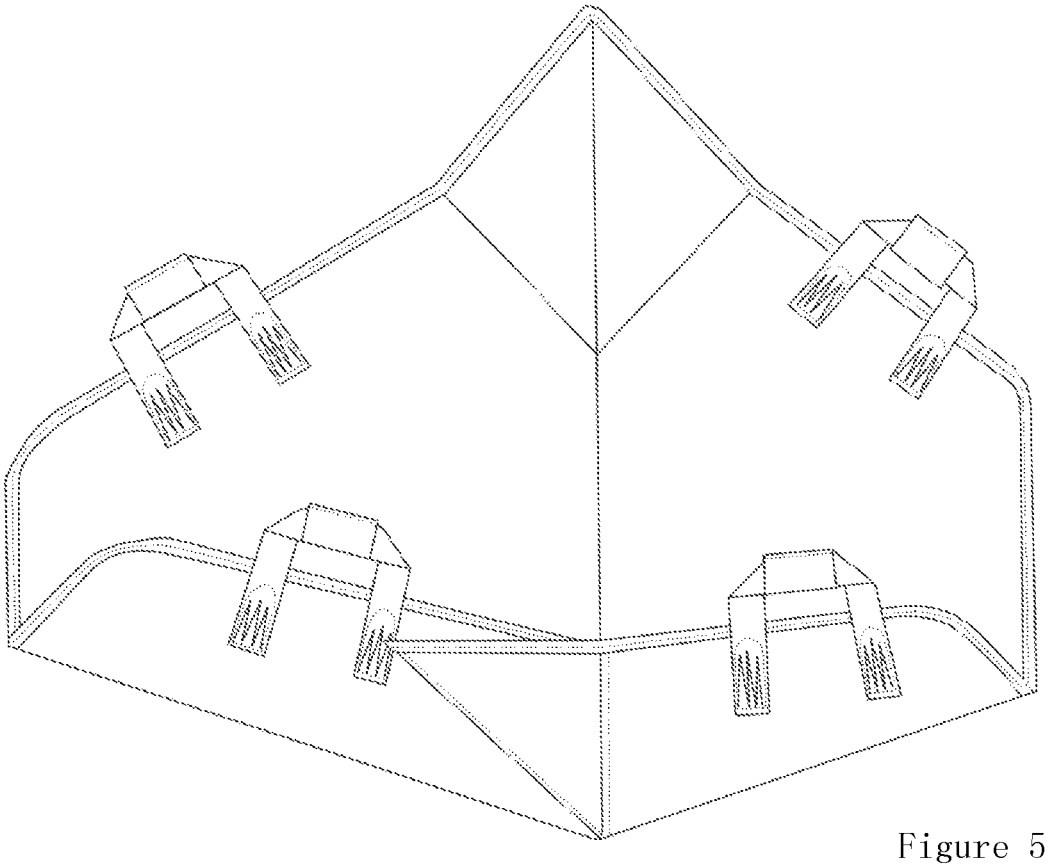
Figure 5F:
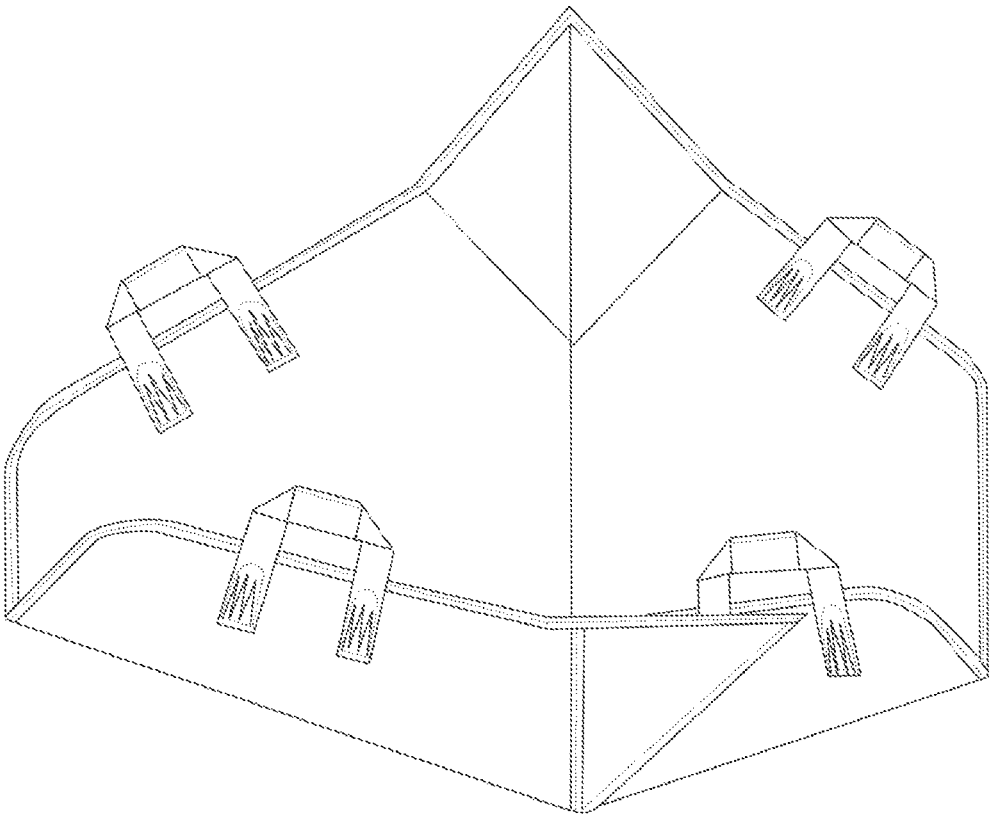
Figure 5G:
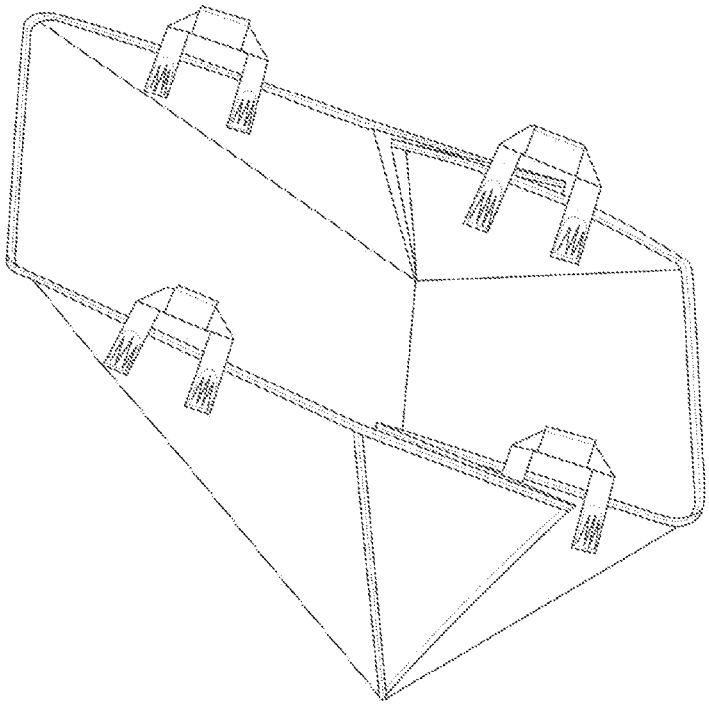
Figure 5H:
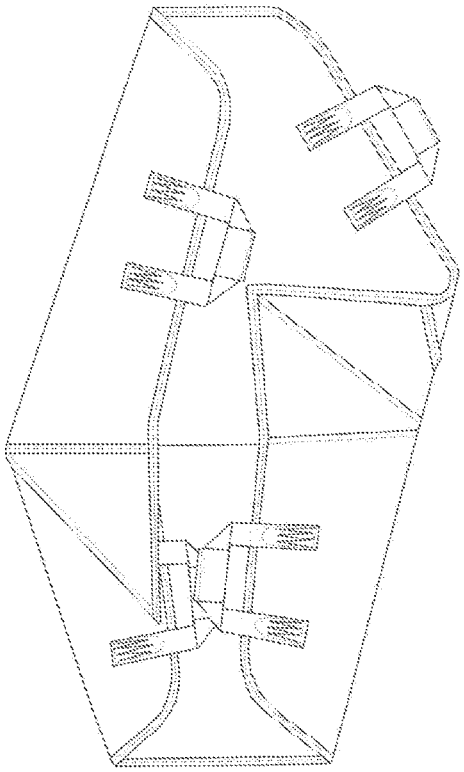
Figure 5I:
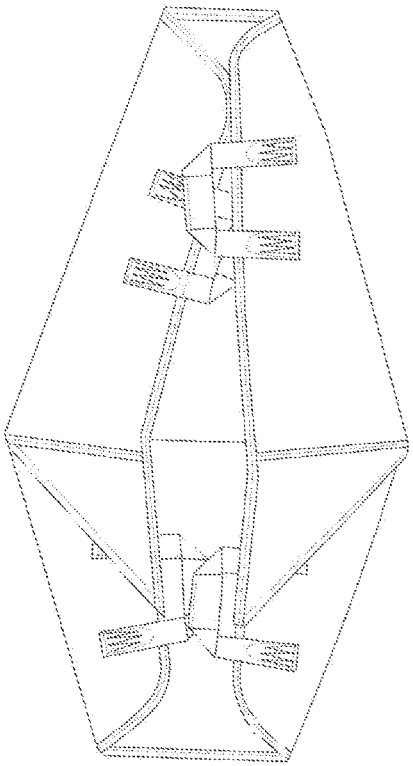

Referring to FIGS. 5A-5I, which are schematic views of a manual lifting sling device being in various operation states or configurations in accordance with another preferred embodiment of the present disclosure. As depicted by the figures, the manual lifting sling device can be folded into different configurations and in various operation states or the intermediate state to facilitate a subsequent or specific operation. For example, the intermediate state or configuration as depicted by FIG. 5C facilitates the transfer of a patient being in the lying state. When desired, two sling device as shown in FIG. 5C might even be used in a side by side manner to transfer a patient who is relatively tall or heavy by 4 persons. Wherein the FIG. 5G is a schematic view of a manual lifting sling device being in the fully operational state or configuration in accordance with another preferred embodiment of the present disclosure. It is substantially in the form of a seat. The respective foldable portions in the folded state is attached to the left side retainer portion 130 and the right side retainer portion 140 by fasteners, such as Velcro, or other functionally equivalent members (such as a button, a zipper, etc.) and being engaged In a hidden state.

Figure 1B:
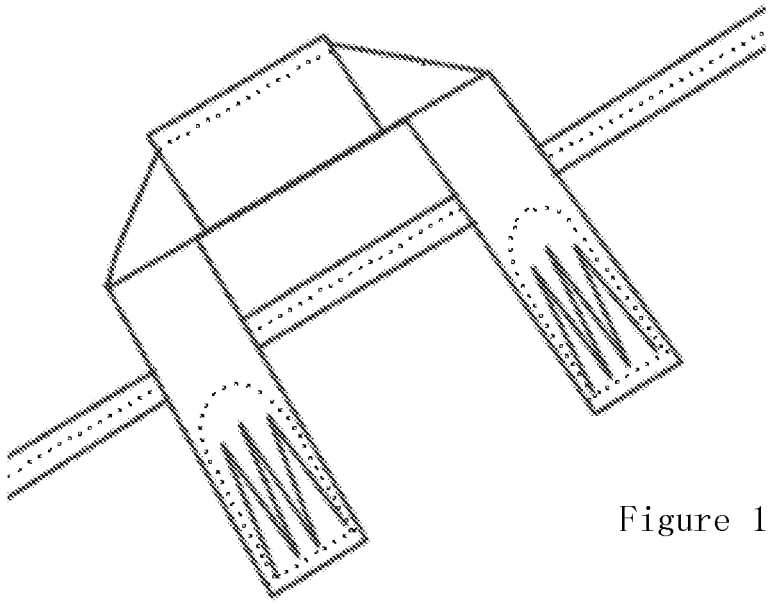
FIG. 1B is a schematic view of a suturing manner of a lift handle of a manual lifting sling device according to a preferred embodiment of the present disclosure.

Now referring to FIG. 1B, which is a schematic view of a suturing manner of a lift handle 150 of a manual lifting sling device according to a preferred embodiment of the present disclosure. As shown in FIG. 1B, the lift handle 150 is connected to other portions in a specific manner, whereby making the connection to be enhanced/strengthened and more durable. For example, a specific pattern might be sewn thereon, such as a plurality of interconnected M-shaped or tooth shaped curves and the peripheral curve as shown in the figure, and the pattern and the sewing/suturing manner enables the provision of a relatively enhanced/stiffened and more durable connection between the handle 150 and the fabric portions connected thereto, as compared to a conventional linear pattern or suturing manner.

In some embodiments, the guide suture, the pre-folded line, and/or the stiffening strip might be sewn by utilizing the specific pattern as described above to provide enhanced and more durable connections.

The present disclosure might comprise, adopt, or be made based on various materials disclosed in the CN103083138A as filed by the present inventor and incorporated herein by reference. It is preferably made of a nonwoven fabric, and an embossed pattern might be formed on the nonwoven fabric by rolling (calendering), so as to have an appearance of the textile/woven fabric. The sling device can be stiffened by an additional fabric layer. Though the recommended safe load of the manual lifting sling device provided by the present disclosure is 120 kg, it has been proved by experiments to be able to withstand 50 times of lifting of a weight of 190 kg without causing any signs of wear thereto.

In addition, the fabric might be a layer of textile or nonwoven film or a composite layer formed by laminating multiple layers of textile or nonwoven film. An air permeable and/or non-permeable film layer might be laminated to the top and/or bottom side of the biodegradable nonwoven fabric of the sling, so as to adsorb any body fluids from the patient and/or to prevent body fluid leakage during lifting and transferring process.

In order to prevent those manual lifting sling devices being discarded and not in use from causing any negative impact on the environment, the fabric of the manual lifting sling devices is preferably made of the biodegradable and/or compostable fabric (see CN103083138A). The biodegradable material employed in the present disclosure ensures that the sling device has a corresponding loading capacity to prevent any accident from happening during lifting process; and it will not increase the manufacturing cost of the sling device so that every patient could afford a dedicated lifting sling device to avoid the occurrence of cross infections.

The present disclosure is described according to specific embodiments, but those skilled in the art will appreciate that various changes and equivalents might be made without departing from the scope of the present disclosure. In addition, many modifications might be made to the present disclosure without departing from the scope of the invention in order to adapt to specific circumstances or materials of the present disclosure. Accordingly, the present disclosure is not limited to the specific embodiments disclosed herein, and shall include all embodiments falling within the scope of the claims.

The invention claimed is:

1. A manual lifting sling device, preferably made of a fabric, comprising a bottom support portion for supporting buttocks and legs of a user, a rear side support portion for supporting the user's back, a left side retainer portion and a right side retainer portion respectively arranged at the left side and the right side and connected with both the bottom support portion and the rear side support portion, and at least two lift handles arranged respectively at each of the left side retainer portion and the right side retainer portion; and a left foldable portion arranged at the left side and respectively connected with the left side retainer portion, the bottom support portion and the rear side support portion; and a right foldable portion arranged at the right side and respectively connected with the right side retainer portion, the bottom support portion and the rear side support portion;

wherein the manual lifting sling device is configured to be switchable between a standby state substantially in form of a two-dimensional sheet and an operation state substantially in form of a three-dimensional seat preferably via a predetermined transformation of the left foldable portion and/or the right foldable portion, and/or a predetermined operation or motion of the handle.

2. The manual lifting sling device according to claim 1, wherein while in the standby state the manual lifting sling device is configured to be in a fully or at least partially unfolded configuration having its entirety or at least one preset active portion being in a flat state for facilitating rolling up operation, stacking operation, storage operation, transport operation, and/or operation for insertion underneath the user; and preferably, the left foldable portion, the right foldable portion, the bottom support portion, the rear side support portion, the left side retainer portion, and/or the right side retainer portion are coplanar.

3. The manual lifting sling device according to claim 1, wherein while in the operation state the manual lifting sling device is configured to be in a partially folded configuration with its entirety being in a three-dimensional state for facilitating seating and/or transport operations of the user; and preferably, the bottom support portion and the rear side support portion are intersected at a first predetermined inclination angle, and both of them are further intersected with the left side retainer portion and the right side retainer portion at a second predetermined inclination angle; and preferably the left side retainer portion and the right side retainer portion are further arranged opposingly and in parallel to each other; and preferably, each of the left and right foldable portions is folded respectively along its center axis and selectively further folded toward respective retainer portions and fixed thereto.

4. The manual lifting sling device according to claim 1, wherein the left and right foldable portions are respectively arranged at transverse ends or ends in width direction of the manual lifting sling device and/or respective centre portions of the left side and/or right side retainer portions; while in the standby state the left foldable portion and/or the right foldable portion being in the unfolded configuration and in coplanar with the bottom support portion, the rear side support portion, the left side retainer portion, and the right side retainer portion; and/or a profile/contour of the left foldable portion and/or the right foldable portion is protruded transversely from respective profiles/contours of respective retainer portions; while in the operation state the left foldable portion and/or the right foldable portion being in the folded or overlapped configuration in which the left foldable portion and the right foldable portion might then be respectively connected firmly with or completely engaged with or in parallel with the left side retainer portion and the right side retainer portion preferably by hook and loop fasteners; and/or the profile/contour of the left foldable portion and/or the right foldable portion is preferably incorporated with respective profiles/contours of respective retainer portions and thus being visually hidden or in a concealed state.

5. The manual lifting sling device according to claim 1, wherein the left foldable portion and/or the right foldable portion further comprise a guide suture, a pre-folded line, and/or a stiffening strip, such that it tends to be converted automatically to the folded or overlapped configuration while in the operation state.

6. The manual lifting sling device according to claim 1, wherein an edge of the left foldable portion, the right foldable portion, the bottom support portion, the rear side support portion, the left retainer portion, and/or the right side retainer portion is folded, pre-folded, and/or stiffened; and/or the left foldable portion, the right foldable portion, the bottom support portion, the rear side support portion, the left side retainer portion, and the right side retainer portion are integrally formed preferably by sewing.

7. The manual lifting sling device according to claim 1, wherein the bottom support portion, the rear side support portion, the left side retainer portion, the right side retainer portion, the left foldable portion, and/or the right foldable portion being cut to fit human body and provided with a fold.

8. The manual lifting sling device according to claim 1, wherein the fabric comprises an identification; and/or the fabric comprises a layer of textile or nonwoven film, or a composite layer formed by laminating multiple layers of textile or nonwoven film.

9. The manual lifting sling device according to claim 1, wherein one side, or both sides, or a top surface, and/or a bottom surface of the fabric comprise an air permeable non-biodegradable or biodegradable film.

10. The manual lifting sling device according to claim 1, wherein the fabric comprises a thermally bonded non-biodegradable or biodegradable randomly oriented fiber; and/or a continuous filament web or a short fiber web formed by spunlace or needle punch.

11. The manual lifting sling device according to claim 1, wherein the fabric comprises a continuous filament web or a short fiber web formed by bonding of a non-biodegradable or biodegradable chemical, and the chemical comprises a latex binder and/or adhesive.

12. A method for preventing cross-infections between patients being conveyed, characterized in that, having each of patients provided with and conveyed by the manual lifting sling device according to claim 1.

* * * * *